United States Patent [19]

Watson et al.

[11] 4,328,111

[45] May 4, 1982

[54] MODIFIED OVERBASED SULFONATES AND PHENATES

[75] Inventors: Roger W. Watson, Batavia; Joseph S. Strukl, Lisle, both of Ill.

[73] Assignee: Standard Oil Company (Indiana), Chicago, Ill.

[21] Appl. No.: 962,283

[22] Filed: Nov. 20, 1978

[51] Int. Cl.[3] ..... C10M 1/40

[52] U.S. Cl. ..... 252/33.4; 252/32.5; 252/32.7 E; 252/42.7

[58] Field of Search ..... 252/32.5, 32.7 E, 33.4, 252/42.7

[56] References Cited

U.S. PATENT DOCUMENTS

| | | | |
|---|---|---|---|
| 2,723,234 | 11/1955 | Asseff et al. | 252/32.7 E |
| 3,044,961 | 7/1962 | Morway et al. | 252/42.7 X |
| 3,135,692 | 6/1964 | Kjonaas | 252/32.7 E |
| 3,372,116 | 3/1968 | Meinhardt | 252/42.7 X |
| 3,544,463 | 12/1970 | Koft, Jr. | 252/32.5 X |
| 3,595,790 | 7/1971 | Norman et al. | 252/32.5 X |
| 3,629,109 | 12/1971 | Gergel et al. | 252/32.7 E X |
| 3,714,042 | 1/1973 | Greenough | 252/33.4 X |
| 3,766,066 | 10/1973 | McMillen | 252/32.7 E |
| 3,965,017 | 6/1976 | Burnop et al. | 252/33.4 X |
| 4,049,560 | 9/1977 | Dominey | 252/42.7 X |

*Primary Examiner*—Andrew Metz

*Attorney, Agent, or Firm*—Frank J. Sroka; William T. McClain; William H. Magidson

[57] ABSTRACT

Disclosed are compositions of matter and a method for their manufacture, and lubricating oil compositions containing such compositions. The compositions of matter comprise the reaction product of basic compound comprising overbased metal sulfonate, phenate, or mixtures thereof, with acidic compound comprising organic carboxylic acid, organic carboxylic acid anhydride, phosphoric acid, phosphoric acid ester, thiophosphoric acid ester, or mixtures thereof.

41 Claims, No Drawings

MODIFIED OVERBASED SULFONATES AND PHENATES

BACKGROUND

This invention relates to compositions of matter, a process for making said compositions of matter, and lubricating oils containing said compositions of matter. This invention especially relates to oil additives and compositions having improved properties.

It is well known that various additives can be added to lubricating oils in order to improve various oil properties and to make a more satisfactory lubricant. Antiwear agents are intended to decrease wear of machine parts. Wear inhibitors for incorporation in motor oils and industrial oils are finding greater use as a result of greater stress placed on moving parts in high performance engines. Numerous additives have been developed for use in such oil compositions to improve the lubricating characteristics thereof and thereby to lessen the wear of the moving parts.

It is also well known that lubricating oils tend to deteriorate under the conditions of use in present day diesel automotive engines, both 2 and 4 cycle, with attendant formations of sludge and lacquer and resinous materials which adhere to the engine parts, particularly the piston ring, groove and skirt, thereby lowering the operating efficiency of the engine. To counteract the formation of these deposits certain chemical additives have been found which when added to lubricating oils have the ability to keep the deposit forming materials suspended in oil so that the engine is kept clean and in efficient operation condition for extended periods of time. These agents are known in the art as detergents or dispersants.

Other additives, such as antirusts to control rust and corrosion, are used in lubricants to improve various other properties. Some common additives used in lubricating oils are metal sulfonates and phenates. In some cases, these additives are overbased, that is, contain a molar excess of base over that needed to neutralize the sulfonic acid or phenolic material. Additive manufacturers generally desire to make these additives with simple processing schemes and at low costs. Users of these additives generally desire high effectiveness with few undesirable side effects, such as poor water sensitivity or incompatibility with other additives.

Overbased metal sulfonates are commonly used in lubricating oil compositions as rust inhibitors and detergents. It is highly desirable for such sulfonates to provide neutralization capacity for acids formed in engine combustion without too rapid loss in alkalinity. The sulfonates are not to be detrimental to engine wear as measured by silver lubricity tests, and should be stable in formulations, such as not forming gels when contacted with water and not forming sediment when contacted with phenols or phenates. High quality overbased metal sulfonates are needed in order to achieve 1-H quality lubricants.

Overbased phenates, including sulfurized phenates, are commonly used in lubricating oil compositions as detergents and antioxidants. These phenates are commonly manufactured in the presence of ethylene glycol which is difficult to remove from the product, thereby wasting raw materials and sometimes leading to undesirable side effects from glycol in the final product. It is desirable for phenates to prevent the formation of deposits such as varnish, for example, as measured by hot tube tests. Again, as with sulfonates, it is desirable to prevent too rapid loss of alkalinity of the phenate when contacted with combustion acids in an engine. Compatability with water and other additives is highly desirable.

It is an object of this invention to provide new compositions of matter and a process for making said compositions.

It is an object of this invention to provide a lubricating oil composition having improved properties, especially improved detergency, antirust, antiwear or water sensitivity.

It is an object of this invention to provide a process to improve solvent separation from the overbased material.

It is still further an object of this invention to provide a simple process for making said compositions at low cost.

SUMMARY OF THE INVENTION

The objects of this invention can be achieved by incorporating acidic compound into the overbased material. This can be done by reacting acidic compound with overbased material or forming the overbased material in the presence of acidic compound. It is generally preferable to first form the overbased material, and then react such material with acidic compound.

The improved compositions of this invention generally comprise the reaction product of basic compound comprising overbased metal sulfonate, phenate, or mixtures thereof, with acidic compound comprising organic carboxylic acid, organic carboxylic acid anhydride, phosphoric acid, phosphoric acid ester, thiophosphoric acid ester, or mixtures thereof. Most commonly, the metal comprises magnesium, calcium, barium, or mixtures thereof, the organic carboxylic acid comprises about 1 to about 100 carbon atoms, the organic acid anhydride comprises about 4 to about 100 carbon atoms, and the phosphoric acid ester or thiophosphoric acid ester comprises

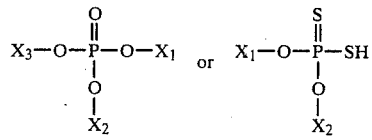

and $X_1$, $X_2$ and $X_3$ comprise hydrogen or about $C_1$ to about $C_{20}$ hydrocarbyl, preferably $X_1$, $X_2$ and $X_3$ comprise hydrogen or about $C_1$ to about $C_{10}$ alkyl groups. Preferably, the organic carboxylic acid comprises about 1 to about 40 carbon atoms, and the organic acid anhydride comprises about 4 to about 60 carbon atoms.

Acidic compound for the purposes of this invention is a Lewis acid which is capable of reacting with overbased sulfonate, phenate, or mixtures thereof, thereby improving the properties of said overbased material. The acidic compound improves the detergency, antirust, antiwear, water sensitivity, processability, or manufacturing solvent separation properties of the overbased sulfonate, phenate, or mixtures thereof. Suitable acidic compounds can be identified by reacting the compounds with overbased material or intermediate of the overbased material, and then testing such reaction product alone or in oil solution by routine tests to determine the improvements described above. Because not all organic carboxylic acids or anhydrides, phosphoric acid or acid esters, or mixtures thereof improve the various above mentioned properties, they must be tested and determined empirically.

The term "basic compound" as used herein refers to materials having a neutralization number greater than about 100, preferably greater than 200, as determined by ASTM D-974. Basic compound generally refers to overbased sulfonate or overbased phenate.

The compositions can be formed over wide ranges of basic compound to acidic compound. Generally, the milliequivalent ratio of basic compound to acidic compound is about 1.5 to about 50:1, preferably about 2 to about 20.

Two of the most common classes of metal sulfonates and phenates are overbased magnesium sulfonate and overbased calcium phenate. One of the preferred overbased magnesium sulfonates comprises overbased alkyl benzene sulfonate comprising about 4 to about 100 carbon atoms in the alkyl group, and having a total base number from about 100 to about 500 based on thirty percent soap. One of the preferred overbased calcium phenates comprises overbased alkyl substituted phenate having about 4 to about 100 carbon atoms in the alkyl group, and having a total base number from about 100 to about 600 based on thirty percent soap.

The additive composition of this invention is generally added to lubricating oil in order to improve various properties of said oil. Depending on the nature of the oil, the intended use and the desired improvement, different amounts of the additive are needed in order to be effective. The additive is generally present in a lubricating oil at a concentration of about 0.05 to about 20 weight percent, preferably about 0.05 to about 5 weight percent, still more preferably about 0.5 to about 2 weight percent. The lubricating oil commonly has a viscosity from about 40 Saybolt Universal Seconds at 100° F. to about 200 Saybolt Universal Seconds at 210° F.

The oil soluble compositions of this invention are generally manufactured by reacting at reaction conditions basic compound comprising overbased metal sulfonate, phenate, or mixtures thereof, with acidic compound comprising organic carboxylic acid, organic carboxylic acid anhydride, phosphoric acid, phosphoric acid ester, thiophosphoric acid ester, or mixtures thereof. Commonly, the reaction is conducted at a temperature from about 75° F. (24° C.) to about 250° F. (121° C.), preferably about 100° F. (38° C.) to about 200° F. (93° C.). In some cases, it is helpful to use water or methanol in order to promote the reaction of acidic compound with basic compound. The desirability of using such a promoter can be determined by routine testing. Often the reaction is conducted in a solvent, such as a light hydrocarbon or lubricating oil.

In most cases, overbased metal sulfonates or phenates are dissolved or suspended in a solvent or oil so that they can be easily transported and dissolved or suspended as additives in lubricating oil. Therefore, such materials are commonly purchased or manufactured with lubricating oil present. Additional oil may be added if desired for the reaction of basic compound with acidic compound in order to reduce viscosity, improve filterability and processability, and the like. It is generally desirable to use diluent lubricating oil of such a quality so that it can remain unseparated in the product and not adversely affect end use. Other diluents such as naphtha, light hydrocarbons, especially $C_5$–$C_8$ hydrocarbons, are more effective at reducing viscosity but most often must be removed from the final product.

In some cases the compositions can be made by reacting acidic compound with intermediate overbased materials. For example, in the manufacture of overbased metal sulfonates and phenates, acidic compound can be added to the reaction mixture after the overbased metal sulfonate or phenate is substantially formed. However, it is generally preferable and convenient to react the basic compound with acidic compound after overbasing is complete. This is conveniently done by contacting the overbased material in a solvent with the acidic compound at a temperature from about 75° F. to about 250° F. for a time sufficient to incorporate at least a portion of the inorganic acid. Preferably, a substantial portion of the acid is incorporated. In some cases, it may be possible to conduct the reaction at higher or lower temperatures. Higher temperatures generally lead to faster reaction time but can also lead to some decomposition. Reaction conditions are generally selected to maintain sufficiently fast reaction periods while maintaining product quality by minimizing decomposition.

The reaction is conveniently carried out at atmospheric pressure, although either pressure or vacuum systems may be used. In some cases it is desirable to blanket the reaction mixture with an inert gas, such as nitrogen, in order to minimize oxidation, degradation, and unwanted side reactions. The reactants should be mixed so that the basic material and acidic material can be readily contacted. The reaction can be carried out on a batch basis where the reactants are introduced into a reaction zone such as a stirred reactor, the reaction carried out and the product removed; or on a continuous basis where controlled proportions of reactants are continuously contacted together at one end of a reaction zone, and product removed from another end of the reaction zone.

Oil soluble overbased metal sulfonates are made by reacting a metal base with oil-soluble sulfonic acids. Suitable oil-soluble sulfonic acids can be aliphatic or aromatic compounds. Suitable aromatic sulfonic acids are the oil-soluble petroleum sulfonic acids, commonly referred to as "mahogany acids," aryl sulfonic acids, and alkaryl sulfonic acids. Illustrative of such sulfonic acids are dilauryl benzene sulfonic acid, lauryl cetyl benzene sulfonic acid, paraffin-substituted benzene sulfonic acids, polyolefin alkylated benzene sulfonic acids, such as polybutylene alkylated benzene sulfonic acids in which the polybutylene substituents have molecular weight of at least about 100, and preferably within the range of from about 100 to about 10,000, and polypropylene alkylated benzene sulfonic acids in which the polypropylene substituents have a molecular weight of at least about 80 and preferably within the range of from about 80 to about 10,000. Examples of other suitable sulfonic acids are diparaffin wax-substituted phenol sulfonic acids, acetyl chlorobenzene sulfonic acids, cetyl-phenol disulfide sulfonic acids, cetyl-phenol monosulfide sulfonic acids, and cetoxy capryl benzene sulfonic acids. Other suitable oil-soluble sulfonic acids are well described in the art, such as for example U.S. Pat. No. 2,616,604; U.S. Pat. No. 2,626,207; and U.S. Pat. No. 2,767,209, and others.

Some metal salts of the above compounds have the general formula

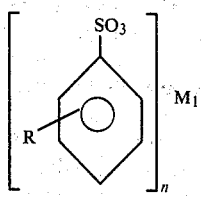

where R is alkyl or hydroxy, chloro or bromo hydrocarbyl; $M_1$ is magnesium, calcium, barium, or mixtures thereof; and n is 2. In some cases the R group can be made by polymerizing $C_2$–$C_6$ olefins to a molecular weight in the range of about 80 to about 10,000, preferably about 80 to about 1,000, and then attaching said group to a benzene ring by well known alkylation techniques. R can be most any hydrocarbon or substituted hydrocarbon which results in an oil soluble benzene sulfonic acid or salt thereof. R can be a low molecular weight alkyl such as iso-butyl, nonyl, dodecyl, and the like; an intermediate molecular weight hydrocarbyl such as $C_{15}$–$C_{100}$ polybutene or polypropylene polymers; a higher molecular weight hydrocarbyl such as polyolefin having a number average molecular weight of 10,000, and others. R can be substituted with groups such as chlorine, bromine, hydroxy, nitro, or sulfonic acid groups. Also, the benzene ring of the sulfonic acid may have more than one substituent alkyl, or hydroxy, halo, nitro or sulfonic acid alkyl groups.

Non-aromatic sulfonic acids are generally made by the sulfonation of most any aliphatic hydrocarbon such as alkanes, alkenes, and the like. Also, the hydrocarbyl may contain various substitutions which do not interfere with later reactions or end use. One preferred group of non-aromatic sulfonic acids is made by the sulfonation of polymers or copolymers, such as polymerized or copolymerized olefins.

The term polymer olefins as used herein refers to amorphous polymers and copolymers derived from olefinically unsaturated monomers. Such olefin monomers include olefins of the general formula $RCH{=}CH_2$, in which R comprises aliphatic or cycloaliphatic radical of from 1 to about 20 carbon atoms, for example, propene, isobutylene, butene-1, 4-methyl-1-pentene, decene-1, vinylidene norbornene, 5-methylene-2-norbornene, etc. Other olefin monomers having a plurality of double bonds may be used, in particular diolefins containing from about 4 to about 25 carbon atoms, e.g., 1,4-butadiene, 2,3-hexadiene, 1,4-pentadiene, 2-methyl-2,5-hexadiene, 1,7-octadiene, etc. These polyolefins have number average molecular weights from about 36 to about 10,000 or higher, but preferably from about 80 to about 10,000. Of these materials, a preferred group is polypropylene or polybutylene polymers. The olefin may be a copolymer, such as an ethylene propylene copolymer or ethylene-propylene-hexadiene terpolymer, or others.

The preparation of the sulfonic acids is well known. Such sulfonic acids can be prepared by reacting the material to be sulfonated with a suitable sulfonating agent, such as concentrated sulfuric acid, fuming sulfuric acid, chlorosulfonic acid or sulfur trioxide for a period of time sufficient to effect sulfonation, and thereafter separating insoluble acid sludge from the oil-soluble sulfonic acid. Overbased sulfonates are commonly made by the reaction of sulfonic acid with metal bases such as the oxide, hydroxide, or carbonate of calcium, magnesium or barium. In some cases the sulfonate can be made from the metal itself or a derivative of said metal. Suitable processes for making overbased sulfonates are described in U.S. Pat. Nos. 3,126,340; 3,492,230; 3,524,814 and 3,609,076. The carbonate overbased magnesium sulfonates are preferably made from MgO and carbon dioxide in the presence of a promotor such as ethylene diamine or ammonia. However, some overbased sulfonates contain no carbonate.

Phenates are generally the reaction product of phenol or substituted phenol with a metal base. Often the metal base is a Group II metal compound. In some cases, phenates also contain sulfur.

Substituted phenols are generally mono-, di-, or trihydrocarbyl substituted, such as alkyl, alkenyl, aryl, aralkyl or alkaryl. Monoalkyl substitution is preferred. The hydrocarbyl can comprise low molecular weight groups such as methyl, ethyl, the isomers of propyl, butyl, pentyl, hexyl, heptyl, octyl, nonyl, decyl, and the like, up to high molecular weight materials having a number average molecular weight of 10,000 or more. These hydrocarbyl substituents can be polymer olefins previously described. Preferred hydrocarbyl substituents have a molecular weight of about 80 to about 10,000, especially from about 80 to about 200. Many commercially available and preferred substituted phenols contain about $C_4$ to about $C_{100}$, more preferably $C_8$–$C_{20}$ substituents from polypropylene or polybutene. The hydrocarbon substituted phenol may have other substituents, such as for example, chlorine, bromine, nitro or sulfonic acid groups so long as such substitution does not interfere with the various reactions nor adversely affect the utility of the composition.

The Group II metal compound can comprise a metal oxide, hydroxide, alcoholate, acetate, and the like. Common metals are calcium, barium, strontium, and magnesium. Preferably the metal compound is calcium oxide or hydroxide. Some metal phenates can be represented by the following hypothetical structure:

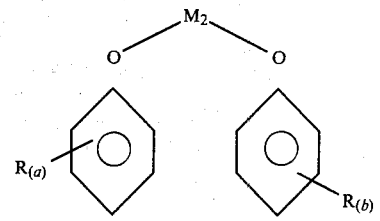

where $M_2$ is a Group II metal, R is a hydrocarbyl group and a and b are 1, 2, 3, or 4. However, because the metal phenate is overbased, this structure may be inaccurate in that an excess of metal base is commonly associated with the above structure.

Some sulfur containing phenates can be represented by the following hypothetical structure:

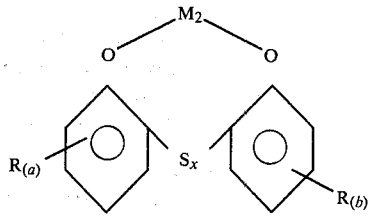

or

-continued

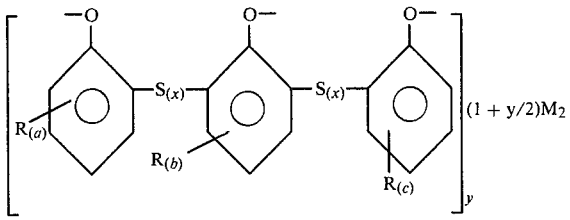

where $M_2$ is a Group II metal, R is a hydrocarbyl group, a, b, and c are 1, 2, 3, or 4; x is 1, 2, 3, or 4; and y is 0–10. However, because the sulfur containing metal phenate is overbased, this structure may be inaccurate in that an excess of metal base is commonly associated with the above structures.

Oftentimes, phenates contain sulfur, such as a sulfur bridge between two phenyl groups containing one, two, three, four, or more sulfur atoms. In some cases, several phenols or substituted phenols are bridged together by a number of sulfur bridges. The sulfur can be introduced by the reaction of elemental sulfur or $SCl_2$ with phenol or substituted phenol, or by the reaction of elemental sulfur or $SCl_2$ with metal phenate.

Methods of making these various phenates and sulfur containing phenates and overbasing can be found in U.S. Pat. Nos. 3,966,621; 3,969,235; 3,953,519; 3,932,289; 3,923,670; 3,801,507; 3,036,971; 3,810,837; 3,761,414; 3,336,224; 3,178,368; 3,437,595; and 3,464,970.

The organic carboxylic acids or acid anhydrides of this invention can vary in molecular weight from extremely low on up to extremely high molecular weight compounds. Generally, the viscosity of such compounds increases with molecular weight and less moles are contained in a given weight. Therefore, it is generally desirable to use acids and anhydrides containing less than 1,000 carbon atoms to aid manufacture of the final product and to prevent the acidic compound from contributing too greatly in weight to the final product.

The organic carboxylic acids can be straight chain or branched, saturated, unsaturated or aromatic. Often an acid will fall within more than one of these categories. The acids may contain substituents such as chlorine, bromine, hydroxy, nitro, oxygen such as ketone, and other groups so long as such substitution is not detrimental to the final product.

Some suitable carboxylic acids are saturated acids such as formic, acetic, propionic, butyric, valeric, caproic, caprylic, capric, lauric, myristic, palmitic, stearic, and branched isomers thereof; unsaturated acids such as oleic, linoleic, linolenic, acrylic, methacrylic, undecylinic; aromatic acids such as benzoic, toluic, chlorobenzoic, bromobenzoic, nitrobenzoic, phthalic, isophthalic, terephthalic, salicylic, hydroxybenzoic, anthranilic, aminobenzoic, methoxybenzoic, hemimellitic, trimellitic, trimesic; dicarboxylic acids such as oxalic, malonic, succinic, glutaric, adipic, pimelic, suberic, azelaic, sebacic, maleic, fumaric, dimerized acids of same or different acids which can be made by the condensation of unsaturated carboxylic acids. Anhydrides of the various dicarboxylic acids, especially vicinal dicarboxylic acids, are suitable acidic compounds for the practice of this invention.

One particularly useful group of carboxylic acids or anhydrides thereof are alkyl or alkenyl substituted dicarboxylic acids or anhydrides thereof. One such acid is alkenyl substituted succinic acid or anhydride. These substituted acids or anhydrides commonly have from about 8 to about 1,000 carbon atoms, preferably about 10 to about 56 carbon atoms, in the alkenyl group. Substituted succinic anhydride is often made by the reaction of maleic anhydride with olefinic materials. Some preferred olefinic materials are low molecular weight alpha-olefins or polymeric olefins. Of these polymers, a preferred group are polypropylene or butylene polymers. A number of the substituted succinic acids and anhydrides are commercially available.

Thiophosphoric acid esters are commonly the reaction products of $P_2S_5$ with alcohols. The reaction of $P_2S_5$ with alcohols is well known from the manufacture of zinc dialkyl or diaryl dithiophosphate. See for example U.S. Pat. No. 4,113,634 which teaches the reaction of about 4 moles of hydroxy compound with one mole of phosphorus pentasulfide at a temperature from about 100° F. (38° C) to about 250° F. (121° C.)

Esters of $H_3PO_4$ are also commonly made by reacting alcohols with $H_3PO_4$ at well known conditions. Most commonly, these esters comprise mono- or di-esters of $C_1$ to about $C_{20}$ alcohols.

A wide range of alcohols are suitable for the various esterification reactions, with many having from about one to about twenty carbon atoms. Preferably, the alcohol contains about one to about ten carbon atoms. The alcohol provides a hydrocarbyl group to the phosphoric or thio phosphoric acid ester which enhances its oil solubility and the oil solubility of the final reaction product of basic compound with acidic compound. The hydrocarbyl can be saturated, unsaturated, branched, straight chain, or aromatic and also have various substitutions such as chlorine, bromine, amino, nitro, acid groups and the like so long as such substitution is not detrimental to reaction of basic compound with acidic compound and is not detrimental to the final product. Some suitable alcohols are methyl, ethyl, propyl, butyl, pentyl, heptyl, octyl, decyl, dodecyl or branched chain alcohols such as methyl or ethyl branched isomers of the above. Primary and secondary alcohols are preferred. Suitable branched alcohols are isopropyl, 2-methyl-1-1-pentanol, 2-ethyl-1-hexanol, 2,2-dimethyl-1-octanol, and alcohols prepared from olefin oligomers such as propylene dimer or trimer by hydroboration-oxidation or by the Oxo process. It may be preferable to use mixtures of alcohols because of their low cost and possible improvements in performance. One especially preferred compound made from alcohols comprises O,O'-dibutyl phosphoric acid.

Some suitable aromatic alcohols are phenol and substituted phenol comprising about 6 to about 20 carbon atoms. Common substituted phenols contain hydrocarbyl groups such as alkyl, alkenyl, aryl, aralkyl or alkaryl. Mono alkyl substitution is preferred. The hydrocarbon substitution can range from low molecular weight groups such as methyl, ethyl, propyl, isopropyl, butyl, isobutyl, and the like up to low molecular weight polymers and copolymers. Many commercially available substituted phenols contain $C_8$–$C_{12}$ substituents from polypropylene or polybutene. The hydrocarbyl substituted phenol may have other substituents, such as for example, chlorine, bromine, nitro, amine, acid groups and the like.

The lubricating oils in which the compositions of this invention are useful as additives and which comprise a major proportion of the lubricating oil compositions may be of synthetic, animal, vegetable, or mineral origin. Ordinarily, mineral lubricating oils are preferred by reason of their availability, general excellence, and low cost. For certain applications, oils belonging to one of the other three groups may be preferred. For instance, synthetic polyester oils such as didodecyl adipate and di-2-ethylhexyl sebacate are often preferred as jet engine lubricants. Normally, the lubricating oils preferred will be fluid oils, ranging in viscosity from about 40 Saybolt Universal Seconds at 100° F. to about 200 Saybolt Universal Seconds at 210° F. This invention contemplates also the presence of other additives in lubricating compositions. Such additives include, for example, dispersants, viscosity index improving agents, pour point depressing agents, anti-foam agents, extreme pressure agents, rust-inhibiting agents, and oxidation and corrosion inhibiting agents.

EXAMPLE 1

Two hundred grams of an oil solution of overbased magnesium sulfonate (6.13 meqs base/gram) and one hundred milliliters xylene are charged to a reaction vessel and the system heated to 180° F. Twenty-six grams formic acid (564.6 meqs acid versus 1,226 meqs overbase) was charged at 180° F. over approximately a one hour period, adjusting the addition rate to minimize foaming. The reactions may be slightly exothermic but any temperature rise is minimal. After the addition of the formic acid, the water of reaction was azeotropically removed. The system was cooled to room temperature and the unreacted solids centrifuged out. The centrifugate was solvent stripped to finished product. (5.33 grams unreacted solids, 90% formic acid incorporation, 4.83 meqs base/gm finished product).

Examples 2–23 are other examples using various acidic agents used to modify the overbased Mg petroleum sulfonate. The procedure for each example is similar to that previously described in Example 1.

| EXAMPLE[1] | MODIFYING AGENT | MEQ'S MODIFYING AGENT | GRAMS MODIFYING AGENT | GRAMS UNREACTED SOLIDS |
|---|---|---|---|---|
| 1 | formic acid | 565 | 26 | 5.33 |
| 2 | glycolic acid | 256 | 20 | 16.16 |
| 3 | neo pentanoic acid | 588 | 60 | 0.0 |
| 4 | neo decanoic acid | 581 | 100 | 0.0 |
| 5 | benzoic acid | 210 | 25.6 | 0.13 |
| 6 | oleic acid | 266 | 75 | 0.72 |
| 7 | oxalic acid | 317 | 14.3 | 4.23 |
| 8 | maleic anhydride | 510 | 25 | 0.32 |
| 9 | O-phthalic acid | 210 | 17.4 | 1.60 |
| 10 | iso dodecenyl succinic acid | 497 | 71 | 0.0 |
| 11 | iso octadecenyl succinic acid | 522 | 92 | 0.0 |
| 12 | $L_4$ polybutene succinic anhydride | 540 | 140 | 0.0 |
| 13 | $L_{10}$ polybutene succinic anhydride | 520 | 150 | 0.0 |
| 14 | 2-ethylhexyl dithiophosphoric acid | 210 | 75 | 0.0 |
| 15 | iso octyl acid phosphate | 612 | 97 | 8.74 |
| 16 | methyl acid phosphate | 611 | 52.4 | 18 |
| 17 | n-propyl acid phosphate | 612 | 62.6 | 34 |
| 18 | iso octadecenyl succinic acid triethanolamine | 520<br>260 | 90<br>38 | 0.0 |
| 19 | iso octadecenyl succinic acid triethanolamine | 140<br>140 | 30<br>21 | 0.0 |
| 20 | boric acid | 1,905 | 40 | 4.06 |
| 21 | boric acid | 1,226 | 25.7 | 0.0 |
| 22 | boric acid | 920 | 19.3 | 1.04 |
| 23 | phosphoric acid | 540 | 18 | 1.7 |

[1]200 grams overbased mg petroleum sulfonate corresponds to 1,226 meq's total base (6.13 meq's/gram). Procedure for each modifying agent is essentially the same as that listed for Example 1 (formic acid).

| EXAMPLE[1] | % INCORPORATION | % MEQ'S BASE AS ACID ANION | % MEQ'S BASE AS $CO_3^{-2}$ $OH^{-1}$ | PRODUCT BASICITY MEQ'S/GM |
|---|---|---|---|---|
| 1 | 90 | 48 | 52 | 4.83 |
| 2 | 30 | 8 | 92 | 5.00 |
| 3 | 100 | 47 | 53 | 4.78 |
| 4 | 100 | 46 | 54 | 4.22 |
| 5 | 99 | 18 | 82 | 5.10 |
| 6 | 99 | 28 | 72 | 3.53 |
| 7 | 70 | 23 | 77 | 4.56 |
| 8 | 99 | 54 | 46 | 4.19 |
| 9 | 92 | 17 | 83 | 5.49 |
| 10 | 100 | 37 | 63 | 5.31 |
| 11 | 100 | 37 | 63 | 4.81 |
| 12 | 100 | 47 | 53 | 3.39 |
| 13 | 100 | 48 | 52 | 3.06 |
| 14 | 100 | 13 | 87 | 4.21 |
| 15 | 100 | 51 | 49 | 4.41 |
| 16 | 90 | 55 | 45 | 5.09 |
| 17 | 81 | 55 | 45 | 4.85 |
| 18 | 100 | 37 | 63 | 4.33 |
| 19 | 100 | 11 | 89 | 5.03 |
| 20 | 94 | 100 | 0 | 5.88 |
| 21 | 100 | 86 | 14 | 6.06 |
| 22 | 97 | 80 | 20 | 5.12 |
| 23 | 90 | 47 | 53 | 4.80 |

[1]200 grams overbased mg petroleum sulfonate corresponds to 1,226 meq's total base (6.13 meq's/gram). Procedure for each modifying agent is essentially the same as that listed for Example 1 (formic acid).

Selected reagents can be incorporated into the Mg overbased sulfonate via the actual overbasing process rather than via the finished product as shown in Example 24.

EXAMPLE 24

One hundred fifty-five grams MgO, six hundred fifty grams sulfuric acid free petroleum sulfonic acid (approximately 0.6 moles), nine hundred milliliters xylene, five hundred milliliters methanol, seventy-five milliliters water, and one hundred grams 5 W oil are charged to a three liter resin kettle and the system heated to 150° F. and held one-half hour. Two hundred grams oleic acid (0.71 moles) was added at 150° F. over a one-half hour period. Four-tenths mole overbasing promoter (ethylene diamine) was added, followed by carbon dioxide for one hour at 150° F. at 1.6 SCFH. Methanol was stripped to 200° F. and one hundred milliliters water added followed by carbon dioxide for two hours at 1.6 SCFH. Volatile solvents were then stripped to 240° F., followed by filtration. No oleic acid or Mg oleate was observed in the unreacted solids indicating one hundred percent oleic acid incorporation. Basicity: 5.70 meq's/gram (theory 5.95 meq's/gm). Solids: 2 vol.% (unmodified process 2 to 5% vol.).

The following tables show the effectiveness of modified overbased magnesium sulfonates in improving performance in several lubricating oil applications.

The hot tube test is used to predict the performance of additives in Caterpillar diesel engines. In the hot tube test, mineral lubricating oil is pumped into the bottom of a cylindrical capillary tube contained in a heating block at test conditions. Before entering the tube, air or air/$NO_x$ is passed through a flow meter and mixed with the oil. Oil flows out the top of the tube into a receptacle. After the test period, the tubes are washed with hexane and compared to a standard rating scale with 10 being clean and 0 being dirty. In this test, the additive package in oil, containing 1.0% of unmodified overbased magnesium sulfonate, rated only 1.8 on a scale of 0 to 10 where 10 is perfect. Several of the modified sulfonates, substituted for the unmodified material, gave ratings of 6.0 or better, indicating excellent detergency.

| CAT I-H VARNISH EVALUATION TEST | |
|---|---|
| TEMPERATURE | 495° F. |
| DURATION | 16 HOURS |
| AIR FLOW | 10 cc/min |
| OIL PACKAGE FLOW | .33 cc/min |
| RATING | 0 dirtiest<br>10 cleanest |
| PACKAGE (LOW ASH) | 4.6% dispersant<br>1.7% Zn alkyldithiophosphate<br>0.1% antifoam<br>5.0% acryloid 704<br>1.0% overbased Mg Sulfonate<br>remainder<br>110N/210N oil |

| EXAMPLE | MODIFYING AGENT | meq's Mg/25 gms test Soln. | % Mg in test Soln. | RATING |
|---|---|---|---|---|
| 1 | formic acid | 1.50 | 0.071 | 3.0 |
| 2 | glycolic acid | 1.95 | 0.092 | 1.5 |
| 3 | neo pentanoic acid | 1.95 | 0.092 | 3.0 |
| 4 | neo decanoic acid | 1.95 | 0.092 | 2.5 |
| 5 | benzoic acid | 1.95 | 0.092 | 6.0 |
| 5 | benzoic acid | 1.60 | 0.075 | 6.0 |
| 6 | oleic acid | 1.95 | 0.092 | 1.5 |
| 7 | oxalic acid | 1.95 | 0.092 | 2.5 |
| 9 | o-phthalic acid | 1.95 | 0.092 | 3.5 |
| 10 | iso-dodecenyl succinic acid | 1.95 | 0.092 | 3.8 |
| 11 | iso octadecenyl succinic acid | 1.95 | 0.092 | 4.5 |
| 12 | $L_4$ polybutene succinic anhydride | 1.0 | 0.047 | 6.0 |
| 13 | $L_{10}$ polybutene succinic anhydride | 1.0 | 0.047 | 6.0 |
| 14 | 2 ethyl hexyl dithiophosphoric acid | 1.95 | 0.092 | 1.8 |
| 15 | iso octyl acid phosphate | 1.40 | 0.066 | 6.0 |
| 16 | methyl acid phosphate | 1.95 | 0.092 | 6.5 |
| 17 | propyl acid phosphate | 1.95 | 0.092 | 4.5 |
| 20 | boric acid | 1.95 | 0.092 | 6.0 |
| 21 | boric acid | 1.95 | 0.092 | 3.5 |
| 22 | boric acid | 1.95 | 0.092 | 3.5 |
| 22 | boric acid | 1.61 | 0.077 | 4.0 |
| 23 | phosphoric acid | 1.95 | 0.092 | 4.0 |
| | NONE | 1.95 | 0.092 | 1.8 |

The following table shows the results of a water sensitivity test of the type used to screen additive for application to marine cylinder oils. 47.5 grams HX-50 oil blended with additive at 1.25 meq's/gm and 2.5 grams distilled water were shaken 3 minutes and settled 24 hours. The appearance of the mixture was then noted. The unmodified overbased magnesium sulfonate (TBN 370) allowed only partial separation of the oil and water with a substantial rag at the interface. In contrast, some of the modified sulfonates gave complete separation with clear oil and water layers, and only a trace of rag at the interface.

| WATER SENSITIVITY | | |
|---|---|---|
| Rating | Example | Modifying Agent |
| 2 | — | None |
| 1 | 1 | formic acid |
| 1 | 2 | glycolic acid |
| 1 | 4 | neodecanoic acid |
| 1 | 8 | maleic anhydride |
| 1 | 9 | o-phthalic acid |
| 1 | 14 | 2-ethyl hexyl dithiophosphoric acid |
| 3 | 7 | oxalic acid |
| 3 | 13 | $L_{10}$ PSA |
| 3 | 20 | $H_3BO_3$ |
| 3 | 23 | $H_3PO_4$ |
| 4 | 3 | neo $C_5$ acid |
| 4 | 5 | benzoic acid |
| 4 | 10 | iso $C_{12}$ PSA |
| 4 | 11 | iso $C_{18}$ PSA |
| 4 | 12 | $L_4$ PSA |
| 4 | 15 | iso octyl acid phosphate |
| 4 | 16 | methyl acid phosphate |
| 4 | 17 | propyl acid phosphate |
| 4 | 21,22 | $H_3BO_3$ |

Rating:
1: Water separated, oil layer clear to slightly hazy, slight rag in water layer
2: Water separated, oil layer hazy, significant rag in water layer
3: Water partly separated, oil layer very hazy, water layer emulsified
4: Entire system emulsified In the following table, the results of a series of rust tests by the ASTM D-665 procedure are listed. In the first table, the modifying reagent is merely mixed into the test oil along with the unmodified sulfonate and not substantially reacted together. Some advantage is shown for some of the reagents, especially oleic acid, a known rust inhibitor. However, when the reagents are reacted according to our invention, as shown in the second table, excellent rust protection is obtained in most cases. Therefore, it can be seen that it is highly desirable to react the basic materials with acidic material so as to achieve improved rust protection in lubricating oils.

THE EFFICACY OF ADDING THE MODIFYING AGENT TO THE OVERBASED MATERIAL

ASTM D-665 RUST TEST — Rating: 0 = 0% Rust, 8 = 100% Rust
TEMPERATURE: 140° F.
DURATION: 20 HOURS
ACID: 2 MEQ'S HCl
TEST SOLUTION: 260 grams total
5W oil
unmodified overbased Mg sulfonate (TBN 370)
modifying agent (same level as in corresponding modified additive)
30 mls distilled water

| AMOUNT SULFONATE | | MODIFYING | AMOUNT MODIFYING AGENT | | RUST |
|---|---|---|---|---|---|
| MEQ'S | WT % | AGENT | MEQ'S | WT % | RATING |
| 32 | 2.0 | formic acid | 15 | 0.27 | 3 |
| 27.9 | 1.75 | formic acid | 15 | 0.27 | 5 |
| 32 | 2.0 | neo decanoic acid | 15 | 0.97 | 4 |
| 21.5 | 1.35 | neo decanoic acid | 9.8 | 0.65 | 4 |
| 32 | 2.0 | oleic acid | 8.8 | 0.96 | 0 |
| 21.5 | 1.35 | oleic acid | 6.0 | 0.65 | 1 |
| 32 | 2.0 | $L_{10}$ polybutene | 15.34 | 1.7 | 4 |
| 17.2 | 1.08 | succinic acid | 8.30 | 0.92 | 4 |
| 32 | 2.0 | iso octadecenyl | 6.11 | 0.84 | 5 |
| 22.6 | 1.42 | succinic acid | 4.22 | 0.58 | 4 |
| 32 | 2.0 | maleic acid | 14.3 | 0.32 | 6 |
| 27.5 | 1.75 | maleic acid | 15.6 | 0.35 | 6 |
| 32 | 2.0 | NONE | — | — | 5 |

THE EFFICACY OF REACTING THE MODIFYING AGENT INTO THE OVERBASING MATERIAL

ASTM D-665 RUST TEST — Rating: 0 = 0% Rust, 8 = 100% Rust
TEMPERATURE: 140° F.
DURATION: 20 HOURS
ACID: 2 MEQ'S HCl
MODIFYING AGENT REACTED INTO OVERBASED MG SULFONATE
TEST SOLUTION: 260 grams total
5W oil
modified overbased Mg sulfonate additive
30 mls distilled water

| MODIFIED ADDITIVE | | ADDITIVE TEST LEVEL | | |
|---|---|---|---|---|
| EXAMPLE | MODIFYING AGENT | WT % | MEQ'S | RATING |
| 1 | formic acid | 2.0 | 26.0 | 0 |
| 4 | neo decanoic acid | 2.0 | 22.0 | 0 |
| 6 | oleic acid | 2.0 | 20 | 0 |
| 13 | $L_{10}$ polymer succinic acid | 2.0 | 16 | 3 |
| 11 | iso octadecenyl succinic acid | 2.0 | 25 | 0 |
| 8 | maleic anhydride | 2.0 | 22 | 2 |

Further rust test results are reported below. Here, additives are grouped according to the rust rating they provide with the best group (0 rust) at the top. Results of various concentrations of the unmodified and modified sulfonates are shown. Zero rusting was obtained with 1% and 2% of many modified additives, but 4.0% of the unmodified allowed trace rust.

ASTM D-665 RUST TEST

TEMPERATURE: 140° F.
DURATION: 20 hours
TEST SOLUTION: 260 Grams 5W Oil + Additive 30 mls Distilled $H_2O$
ACID: 2 MEQ's HCl

| EXAMPLE | MODIFYING AGENT | ADDITIVE TEST LEVEL MEQ'S | WT % | % /Rust | RUST RATING |
|---|---|---|---|---|---|
| — | NONE | 80 | 5 | 0 | 0 |
| 1 | Formic acid | 13 | 1 | 0 | 0 |
| 4 | Neodecanoic acid | 22 | 1 | 0 | 0 |
| 6 | Oleic acid | 10 | 1 | 0 | 0 |
| 15 | Iso-octyl acid phosphate | 11 | 1 | 0 | 0 |
| 18,19 | Iso-octyldecenyl succinic acid triethanolamine reaction product | 13 | 1 | 0 | 0 |
| 10 | Iso-dodecenyl succinic acid | 28 | 2 0 | 0 | |
| 14 | 2-ethylhexyldithiophosphoric acid | 21 | 2 | 0 | 0 |
| 22 | | | | | |
| — | NONE | 64 | 4 | trace | 1 |
| 8 | Maleic anhydride | 22 | 2 | trace | 2 |
| 12 | $L_4$ polybutene succinic acid | 17 | 2 | trace | 2 |
| — | NONE | 48 | 3 | 5-10 | 3 |
| 3 | Neo pentanoic acid | 25 | 2 | 5-10 | 3 |
| 13 | $L_{10}$ polybutene succinic acid | 16 | 2 | 5-10 | 3 |
| 20,21,22 | Boric acid | 30 | 2 | 5-10 | 3 |
| — | NONE | 32 | 2 | 20 | 5 |
| 2 | Glycolic acid | 26 | 2 | 20 | 5 |
| 7 | Oxalic acid | 23 | 2 | 20 | 5 |
| — | NONE | 16 | 1 | 90 | 7 |
| — | NONE | 0 | 0 | 100 | 8 |

The presence of glycol in overbased phenates can cause engine varnish. A glycol identification test can be used to indicate the presence of ethylene glycol in crankcase lube. In addition to improved varnish properties, the increased recovery of glycol from phenates has an obvious economic incentive.

We have shown that overbased phenates can be modified to release glycol by treatment with suitable reagents. Phenates thus treated can be subsequently stripped, for example by purging with nitrogen, to remove the released glycol. While the data shown were obtained from treating finished phenates with acidic compounds, it is apparent that the appropriate use of reagents during processing, e.g., introduction of reagents before initial stripping, can simplify the processing and reduce the cost.

The release of glycol was determined by oxidation of glycol with periodate, followed by titration of excess periodate with $H_3AsO_3$ and $I_2$. About 5 gms sample +25 mls 0.03 m $NaIO_4$ (benzene also for solution of sample) is stirred at room temperature and then buffered with saturated $Na_2CO_3$. 30 mls 0.05 m arsenious acid solution is added, and then 5 mls starch solution is added. The arsenious acid can be generated by the reaction of $As_2O_3$ with excess sodium hydroxide, followed by acidification with hydrochloric acid. The mixture is then titrated with $I_2$. Because the various phenate samples are dissolved in lubricating oil from manufacture, the TBN (total base number) adjusted to include oil stripped out $$\frac{(TBN)\ (\text{wt. of stripped sample})}{(\text{wt. of starting sample})} = \text{corrected } TBN$$

sample = phenate in oil + additive.

TBN of sample prior to stripping and assuming secondary additive Ca salt titrates $$\text{Theory } TBN = \frac{259\ (\text{phenate} + \text{oil})}{(\text{wt. phenate} + \text{oil} + \text{wt. additive})}$$

The unmodified sulfurized calcium phenate used in the examples was made from approximately $C_9$–$C_{12}$ polybutene substituted phenol, sulfur, calcium hydroxide, and carbon dioxide. The overbasing was conducted in the presence of ethylene glycol solvent and a lubrication oil diluent. Modifying agent acidic compound was added to the finished overbased sulfurized phenol and the mixture nitrogen stripped to remove glycol. The following data shows that various modifying agents added to the overbased phenate aids in the removal of glycol.

| Additive | Stripping % Wt. Loss | Corrected TBN After Stripping | Theor. TBN | %* TBN |
|---|---|---|---|---|
| No modifying agent | — | | | |
| No stripping | — | 259 | — | — |
| No modifying agent | — | | | |
| $N_2$ stripping | 14.2 | — | — | — |
| C-18 PSA | 25.2 | 212 | 205 | +3.4 |
| EDTA | 9.70 | 232 | 234 | −0.85 |
| Oleic Acid | 8.14 | 187 | 186 | +0.54 |
| Neo C-10 Acid | 24.17 | 209 | 204 | +2.5 |
| Formic Acid | 27.95 | 214 | 224 | −4.5 |
| $H_3BO_3$ | 17.95 | 250 | 246 | +1.6 |
| Triethanolamine | 8.56 | 272 | 279 | −2.5 |
| Benzoic Acid | 16.45 | 221 | 219 | +0.9 |
| $H_3PO_4$ | 1.51 | — | — | — |
| EDA | 18.62 | — | — | — |
| $HNO_3$ | 1.02 | — | — | — |

Corrected: Value adjusted to account for wt. loss on stripping and secondary additive dilution.

$$* \frac{\text{Corrected TBN-Theory TBN}}{\text{Theory TBN}} \times 100 = \%\ \text{TBN}$$

| Additive | Corrected % Glycol Observed | Corrected % Glycol Theoretical | %** Glycol |
|---|---|---|---|
| No modifying agent | — | | |
| No stripping | 3.88 | — | — |
| No modifying agent | — | | |
| $N_2$ stripping | 3.79 | 3.88 | −2.3 |
| C-18 PSA | 2.29 | 3.07 | −25.4 |
| EDTA | 2.19 | 3.50 | −37.4 |
| Oleic Acid | 2.39 | 2.78 | −14.0 |
| Neo C-10 Acid | 1.94 | 3.05 | −36.4 |
| Formic Acid | 1.64 | 3.61 | −54.6 |
| $H_3BO_3$ | 2.35 | 3.68 | −36.1 |
| Triethanolamine | 2.62 | 3.20 | −18.1 |
| Benzoic Acid | 2.22 | 3.28 | −32.3 |
| $H_3PO_4$ | 2.95 | 3.65 | −19.2 |
| EDA | 2.96 | 3.96 | −25.2 |
| $HNO_3$ | 2.61 | 3.64 | −28.3 |

Corrected: Value adjusted to account for wt. loss on stripping and secondary additive dilution.

** $\frac{\text{Corrected \% Glycol-Theoretical \% Glycol}}{\text{Theoretical \% Glycol}} \times 100 = \text{\% Glycol}$

We claim:

1. A lubricating oil composition comprising a major proportion of lubricating oil and an effective amount of an improved oil soluble additive comprising about 0.05 to about 20 weight percent of the composition, said additive comprising the reaction product of basic compound comprising overbased metal sulfonate with acidic compound comprising phosphoric acid, phosphoric acid ester, or mixtures thereof, or overbased metal phenate with acidic compound comprising phosphoric acid, phoshoric acid ester or mixtures thereof.

2. The composition of claim 1 wherein the phosphoric acid ester comprises

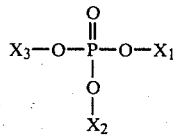

wherein $X_1$, $X_2$ and $X_3$ comprise hydrogen or about $C_1$ to about $C_{20}$ hydrocarbyl.

3. The composition of claim 2 wherein $X_1$, $X_2$ and $X_3$ comprise hydrogen or about $C_1$ to about $C_{10}$ alkyl groups.

4. The composition of claim 1 wherein the metal comprises magnesium, calcium, barium, or mixtures thereof.

5. The composition of claim 1 wherein the milliequivalent ratio of basic compound to acidic compound is about 1.5 to about 50:1.

6. The composition of claim 5 wherein the milliequivalent ratio of basic compound to acidic compound is about 2 to about 20:1.

7. The composition of claim 1 wherein the additive is present at a concentration of about 0.05 to about 5 weight percent.

8. The composition of claim 1 wherein the additive is present at a concentration of about 0.5 to about 2 weight percent.

9. The composition of claim 1 wherein the lubricating oil has a viscosity from about 40 Saybolt Universal Seconds at 100° F. to about 200 Saybolt Universal Seconds at 210° F.

10. The composition of claim 1 wherein the additive comprises a reaction product of overbased magnesium sulfonate.

11. The composition of claim 10 wherein the overbased magnesium sulfonate comprises overbased alkyl benzene sulfonate comprising about 4 to about 100 carbon atoms in the alkyl group, and having a total base number from about 50 to about 500 based on a thirty percent soap.

12. The composition of claim 11 wherein the acidic compound comprises phosphoric acid ester having about $C_1$ to about $C_{10}$ alkyl groups.

13. The composition of claim 1 wherein the additive comprises a reaction product of overbased calcium phenate.

14. The composition of claim 13 wherein the overbased calcium phenate comprises an overbased alkyl substituted phenate comprising about 4 to about 100 carbon atoms in the alkyl group, and having a total base number from about 100 to about 600 based on a thirty percent soap.

15. An oil soluble composition comprising the reaction product of basic compound comprising overbased metal sulfonate with acidic compound comprising phosphoric acid, phosphoric acid ester, or mixtures thereof, or overbased metal phenate with acidic compound comprising phosphoric acid, phosphoric acid ester or a mixtures thereof.

16. The composition of claim 15 wherein the phosphoric acid ester comprises

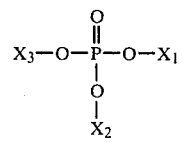

wherein $X_1$, $X_2$ and $X_3$ comprise hydrogen or about $C_1$ to about $C_{20}$ hydrocarbyl.

17. The composition of claim 16 wherein $X_1$, $X_2$ and $X_3$ comprise hydrogen or about $C_1$ to about $C_{10}$ alkyl groups.

18. The composition of claim 15 wherein the metal comprises magnesium, calcium, barium, or mixtures thereof.

19. The composition of claim 15 wherein the milliequivalent ratio of basic compound to acidic compound is about 1:5 to about 50:1.

20. The composition of claim 19 wherein the milliequivalent ratio of basic compound to acidic compound is about 2 to about 20:1.

21. The composition of claim 15 wherein the composition comprises a reaction product of overbased magnesium sulfonate.

22. The composition of claim 21 wherein the overbased magnesium sulfonate comprises overbased alkyl benzene sulfonate comprising about 4 to about 100 carbon atoms in the alkyl group, and having a total base number from about 50 to about 500 based on a thirty percent soap.

23. The composition of claim 15 wherein the composition comprises reaction product of overbased calcium phenate.

24. The composition of claim 23 wherein the overbased calcium phenate comprises an overbased alkyl substituted phenate comprising about 4 to about 100 carbon atoms in the alkyl group, and having a total base number from about 100 to about 600 based on a thirty percent soap.

25. A process for the manufacture of oil soluble compositions comprising reacting at reaction conditions basic compound comprising overbased metal sulfonate with acidic compound comprising phosphoric acid, phosphoric acid ester, or mixtures thereof, or overbased metal phenate with acidic compound comprising phosphoric acid, phosphoric acid ester or mixtures thereof.

26. The process of claim 25 wherein the phosphoric acid ester comprises

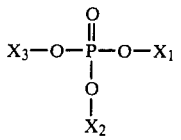

wherein $X_1$, $X_2$ and $X_3$ comprise hydrogen or about $C_1$ to about $C_{20}$ hydrocarbyl.

27. The process of claim 26 wherein $X_1$, $X_2$ and $X_3$ comprise hydrogen or about $C_1$ to about $C_{10}$ hydrocarbyl.

28. The process of claim 25 wherein the metal comprises magnesium, calcium, barium, or mixtures thereof.

29. The process of claim 25 wherein the milliequivalent ratio of basic compound to acidic compound is about 1.5 to about 50:1.

30. The process of claim 29 wherein the milliequivalent ratio of basic compound to acidic compound is about 2 to about 20:1.

31. The process of claim 25 wherein the basic compound is reacted with acidic compound at a temperature of about 75° F. to about 250° F.

32. The process of claim 31 wherein the basic compound is reacted with acidic compound at a temperature of about 100° F. to about 200° F.

33. The process of claim 25 wherein said basic compound is first substantially formed in a first reaction mixture, and said first reaction mixture is reacted at reaction conditions with acidic compound comprising phosphoric acid, phosphoric acid ester, or mixtures thereof.

34. The process of claim 25 wherein the composition comprises reaction product of overbased magnesium sulfonate.

35. The process of claim 34 wherein the overbased magnesium sulfonate comprises an overbased alkyl benzene sulfonate comprising about 4 to about 100 carbon atoms in the alkyl group, and having a total base number from about 50 to about 500 based on a thirty percent soap.

36. The process of claim 25 wherein the composition comprises reaction product of overbased calcium phenate.

37. The process of claim 36 wherein the overbased calcium phenate comprises an overbased alkyl substituted phenate comprising about 4 to about 100 carbon atoms in the alkyl group, and having a total base number from about 100 to about 600 based on a thirty percent soap.

38. A lubricating oil composition comprising a major proportion of lubricating oil and an effective amount of an improved oil soluble additive comprising about 0.05 to about 20 weight percent of the composition, said additive comprising the reaction product of oil soluble substituted benzene sulfonic acid; calcium, magnesium, or barium metal base, or mixtures thereof; and acidic compound comprising phosphoric acid ester, or mixtures thereof; or substituted phenol; calcium, magnesium, or barium metal base, or mixtures thereof; and acidic component comprising phosphoric acid, phosphoric acid ester or mixtures thereof.

39. The composition of claim 38 wherein the substituted sulfonic acid comprises alkyl benzene sulfonate comprising about 4 to about 100 carbon atoms in the alkyl group, the substituted phenol comprises alkyl phenol comprising about 4 to about 100 carbon atoms in the alkyl group, and the phosphoric acid ester comprises

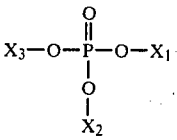

wherein $X_1$, $X_2$ and $X_3$ comprise hydrogen or about $C_1$ to about $C_{20}$ hydrocarbyl, and the milliequivalent ratio of base, calculated as excess base over that needed to neutralize the sulfonic acid or phenol, to acidic compound is about 1.5 to about 50:1.

40. A lubricating oil composition comprising a major proportion of lubricating oil and an effective amount of an improved oil soluble additive comprising about 0.05 to about 20 weight percent of the composition, said additive comprising the reaction product of basic compound comprising overbased metal sulfonate with acidic compound comprising phosphoric acid, phosphoric acid ester or mixtures thereof.

41. A lubricating oil composition comprising a major proportion of lubricating oil and an effective amount of an improved oil soluble additive comprising about 0.05 to about 20 weight percent of the composition, said additive comprising the reaction product of basic compound comprising overbased metal phenate with acidic compound comprising phosphoric acid, phosphoric acid ester, or mixtures thereof.

* * * * *